US006205200B1

(12) United States Patent
Boyer et al.

(10) Patent No.: US 6,205,200 B1
(45) Date of Patent: Mar. 20, 2001

(54) MOBILE X-RAY UNIT

(75) Inventors: Craig N. Boyer, Mitchellville; Glenn E. Holland, Wheaton, both of MD (US); John F. Seely, Lorton, VA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 08/738,927

(22) Filed: Oct. 28, 1996

(51) Int. Cl.[7] ..... H05G 1/06
(52) U.S. Cl. ..... 378/101; 378/102; 378/114
(58) Field of Search ..... 378/101, 102, 378/103, 106, 114

(56) References Cited

U.S. PATENT DOCUMENTS 3,878,394 * 4/1975 Golden ..... 378/102
4,924,485 * 5/1990 Hoeberling ..... 378/102
5,442,677 * 8/1995 Golden et al. ..... 378/102

* cited by examiner

*Primary Examiner*—David P. Porta
(74) *Attorney, Agent, or Firm*—Thomas E. McDonnell; George Jameson

(57) ABSTRACT

A portable X-ray unit, of a relatively light-weight, occoping a volume of less then one-half a cubic foot containing an x-ray head assembly, a unique Marx generator, a plurality of spark-gap switches and control electronics is disclosed. The Marx generator allows for the development of a relatively high voltage in excess of 100 kV, yet allows for the discharge thereof within the nanosecond range. The Marx generator is enclosed by an acrylic insulator that cooperates with an aluminum enclosure, which functions as a return current path for the capacitors in the Marx generator and also as a shield against the escape of electromagnetic radiation from the pulsed x-ray unit. The Marx generator and spark-gap switches are confined within the pressurized chamber that may contain nitrogen gas to reduce the separation of the gap in the spark-gap switches.

16 Claims, 9 Drawing Sheets

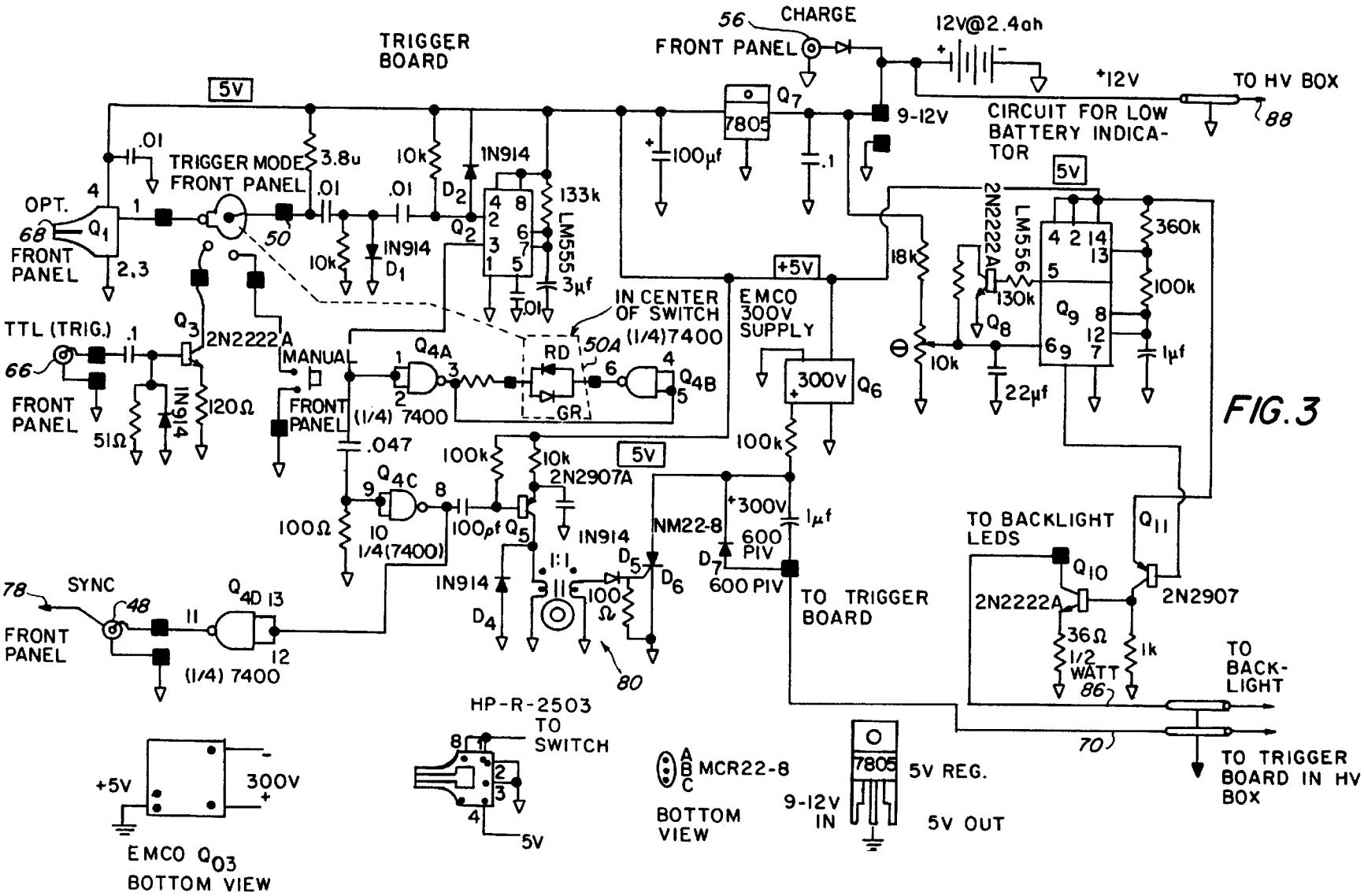
FIG. 3
TO HV BOX
88
+12V
CIRCUIT FOR LOW BATTERY INDICATOR
12V@2.4ah
9-12V
CHARGE
56
FRONT PANEL
Q7
7805
100μf
.1
+5V
EMCO 300V SUPPLY
Q6
300V
18k
10k
LM556
2N2222A
Q8
22μf
360k
100k
1μf
Q9
5V
IN CENTER OF SWITCH
(1/4)7400
Q4B
Q4A
RD
GR
50A
133k
LM555
3μf
.01
1N914
D2
Q2
10k
D1
3.8u
TRIGGER MODE
FRONT PANEL
50
TRIGGER BOARD
OPT.
68
Q1
2,3
TTL (TRIG.)
66
.1
Q3
2N2222A
120Ω
51Ω
MANUAL
.047
Q4C
(1/4) 7400
100Ω
100pf
Q5
2N2907A
D4
D5
D6
D7
NM22-8
600 PIV
300V
TO TRIGGER BOARD
Q11
2N2907
1k
TO BACKLIGHT LEDS
Q10
2N2222A
36Ω
1/2 WATT
86
70
TO BACK-LIGHT
TO TRIGGER BOARD IN HV BOX
5V REG.
5V OUT
9-12V IN
MCR22-8
BOTTOM VIEW
80
HP-R-2503 TO SWITCH
Q4D
SYNC
48
78
FRONT PANEL
300V
+5V
EMCO Q03 BOTTOM VIEW

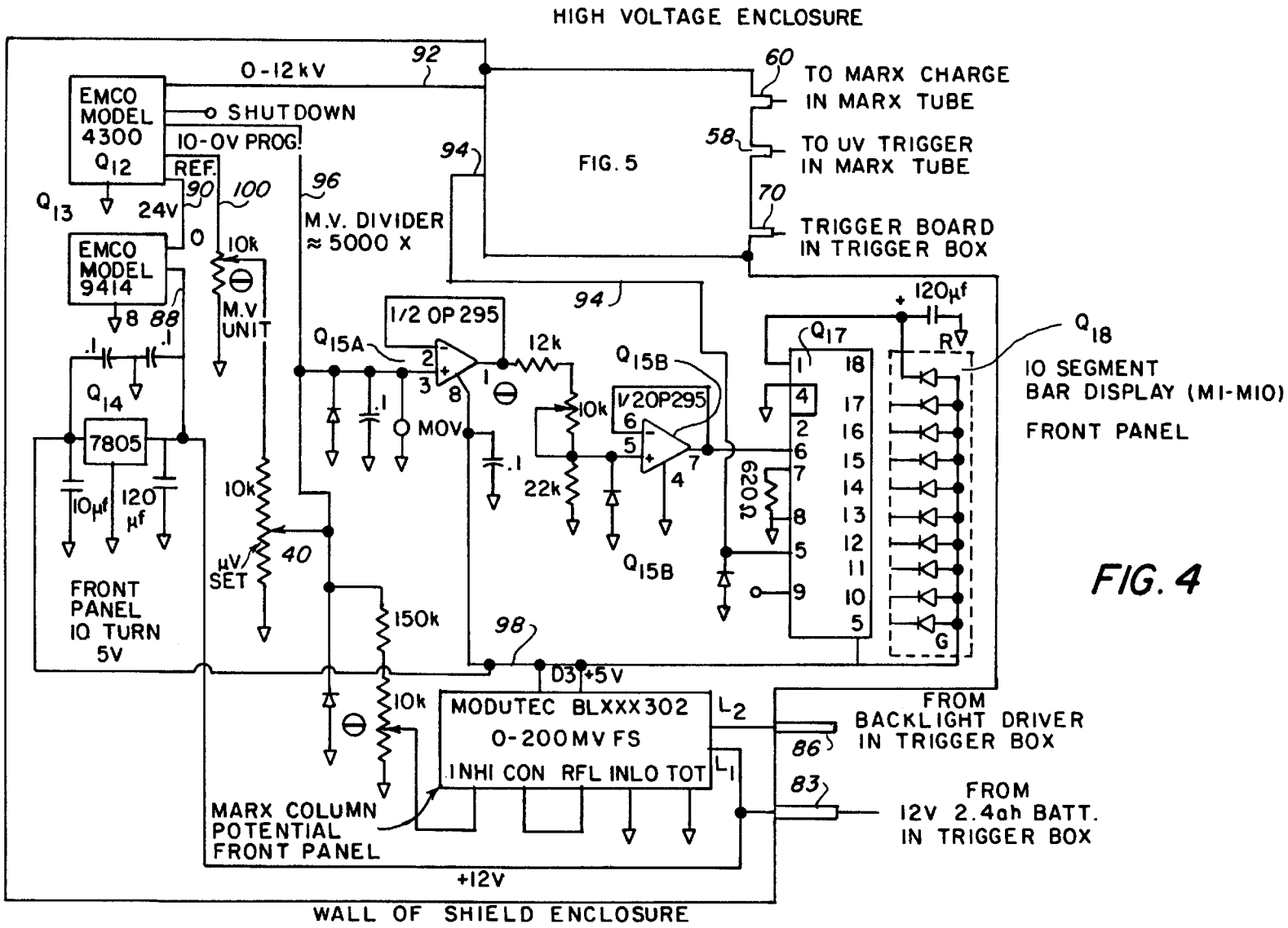
HIGH VOLTAGE ENCLOSURE
TO MARX CHARGE IN MARX TUBE
TO UV TRIGGER IN MARX TUBE
TRIGGER BOARD IN TRIGGER BOX
10 SEGMENT BAR DISPLAY (M1-M10) FRONT PANEL
FROM BACKLIGHT DRIVER IN TRIGGER BOX
FROM 12V 2.4ah BATT. IN TRIGGER BOX
FIG. 5
620Ω
1/2 OP295
MODUTEC BLXXX302 0-200MV FS
INHI CON RFL INLO TOT
M.V. DIVIDER ≈ 5000 X
0-12kV
SHUTDOWN
10-0V PROG.
REF.
EMCO MODEL 4300
EMCO MODEL 9414
7805
M.V UNIT
μV SET
FRONT PANEL 10 TURN 5V
MARX COLUMN POTENTIAL FRONT PANEL
WALL OF SHIELD ENCLOSURE
+12V
FIG. 4

MOBILE X-RAY UNIT

BACKGROUND OF THE INVENTION

1. Field of the Invention

The present invention relates to X-ray machines and, more particularly, to a battery operated X-ray machine having an improved circuit arrangement so as to generate intense relatively short pulsed of X-rays. This invention allows for the overall weight of the X-ray machine to be reduced with a corresponding reduction in its physical size so that it more advantageously serves as a portable device.

2. Description of the Prior Art is X-ray machines that generate X-rays from cold field emission of electrons from the cathode of an X-ray tube are commonly employed in pulsed shadowgraph radiographs. Pulsed or flash shadowgraph radiograph was developed in 1938 as a means for observing extremely rapid motion where the subject was obscured from observation with visible light or debris. To date, flash radiography remains the principal means of observing lensed implosions and ballistic impacts over microsecond and nanosecond time scales. The majority of these X-ray systems utilize the well known Marx generator which can be viewed as a distributed transmission-storage line, consisting of n-cascaded high-voltage barium titanate disc capacitors. To produce X-rays, the Marx generator is coupled to a field-emission X-ray tube either directly or by coaxial cables. Coaxial cables provide a low impedance energy store and can be rapidly discharged into the X-ray tube.

When high voltage (H.V.) pulses arrive at the anode of the X-ray tube they establish a large potential gradient in the anode-cathode gap. This gradient produces an intense electric field at the tips of the small metal whiskers which are present on the surface of the cathode mesh. The whiskers are heated by the passage of the field emission electron current and vaporize, creating a neutral plasma which acts as a virtual cathode capable of supporting a much larger current. Electrons emitted from the expanding virtual cathode are accelerated by the electric field in the anode-cathode gap and eventually collide with the anode creating X-rays by the usual Bremmstrahlung and line radiation processes. Electrons continue to cross the anode-cathode gap until the expanding cathode plasma reaches the anode at which time the X-ray tube impedance drops to a few ohms and effectively shorts the tube.

While Marx generator driven X-ray systems have worked well in the past, they have employed large transformer-rectifier high voltage power supplies for charging the Marx capacitors and generally use heavy coaxial cables to couple the Marx generator to the X-ray tube. The heavy coaxial cables act to sharpen the high voltage pulses produced by the Marx generator but, the physically large bundle of cables disadvantageously adds to the weight of the X-ray machine so as to hinder its portability. Further more, the heavy high voltage power supply also disadvantageously contributed to the weight of the X-ray machine while also hindering its maneuverability. It is desired that a means be provided that reduce the overall weight of the X-ray machine, while also eliminating the need for the heavy coaxial cables with both features contributing to an X-ray unit that is truly portable. More particularly, it is desired that a compact and portable design for X-ray machines be provided so that the X-ray machine may advantageously be used in remote locations, as in X-ray imaging devices for medical diagnostics and also for triage related to medical disasters.

OBJECTS OF THE INVENTION

Accordingly, it is a primary object of the present invention to provide an X-ray machine that is of a relatively light-weight, about 26 pounds,occupies less than one half of a cubic foot,and may serve as a compact and portable device for use in remote locations requiring ease of mobility.

It is the object of the present invention to provide a portable X-ray machine that develops an intense pulse of X-rays, but also has variable accelerating voltage so as to accommodate various X-ray applications.

Another object of the present invention is to provide a portable X-ray unit that generates a high dose X-ray pulse, which has a short time duration, 10–100 nanoseconds. This short X-ray pulse eliminates the need for long integration time, so that it advantageously may be used for high resolution digital detector arrays.

Detector arrays, such as charge coupled device(CCD) or a amorphous silicon devices both of which are used in digital processing cameras have high dark currents when integrating over long time exposures unless cooled to about 0° Fahrenheit; the dark current of these devices decreases their sensitivity.

Furthermore, it is an object of the present invention to provide an X-ray unit that may be used for dental X-ray imagery and controlled by a portable computer, such as a notebook computer, when used in remote or confined spaces or used for X-ray inspection, security detection, and medical applications requiring high quality X-ray images.

SUMMARY OF THE INVENTION

The present invention is directed to an X-ray unit which is relatively light-weight, thereby contributing to its portability, yet generating hard X-ray pulses without the need of any coaxial cables between its Marx generator and its X-ray tube. The X-ray unit comprises a high vacuum X-ray tube having a conical anode surrounded by a coaxial annulus of stainless steel mesh which serves as the cathode, control electronics, and a plurality of spark gap switches and ceramic disc capacitors which form the Marx generator 18. The battery powered control electronics comprises: the H.V. power supply, Ultraviolet (U.V.) flash-gap assembly 57, and power management circuit. The control electronics 20 can receive either a manual, an optical, or an electrical pulse and use that pulse to trigger the X-ray unit.

The control electronics also generates a sync pulse whenever the Marx generator is triggered and this pulse is brought to the front panel of the control electronics enclosure 20 so that it can be used to synchronize or command other devices to fire with the Marx generator.

The energy storage capacitors within the Marx column are surrounded with an insulating pressurized shell 12 and covered by a close fitting aluminum cylinder 32 which acts as the outer conductor of a lumped coaxial transmission line. The outer aluminum cylinder also functions as a very effective Faraday shield preventing the escape of potentially harmful electromagnetic radiation from the pulsed X-ray unit.

BRIEF DESCRIPTION OF THE DRAWINGS

These and other objects, features and advantages of the invention, as well as the invention itself, will become better understood with reference to the following detailed description when considered in connection with the accompanying drawings, wherein like reference numbers designate identical or corresponding parts throughout the several views and wherein:

FIG. 3 is a schematic diagram of the portion of the control electronics of the present invention.

FIG. 4 is a schematic diagram of the further section of the control electron of the present invention.

DETAILED DESCRIPTION OF THE EMBODIMENTS OF THE INVENTION

Before the drawings are discussed, it should be noted that the mobile X-ray unit of the present invention is of a relatively light-weight, about 26 pounds, and provides a Marx generator that contributes to the production of high power X-ray pulse having a predetermined duration and adjustable accelerating potential. The Marx generator comprises a plurality of capacitors that are discharged in several nanoseconds thereby eliminating the need of any pulse sharpening commonly performed by coaxial cables discussed in the "Background" section.

Figure 1:
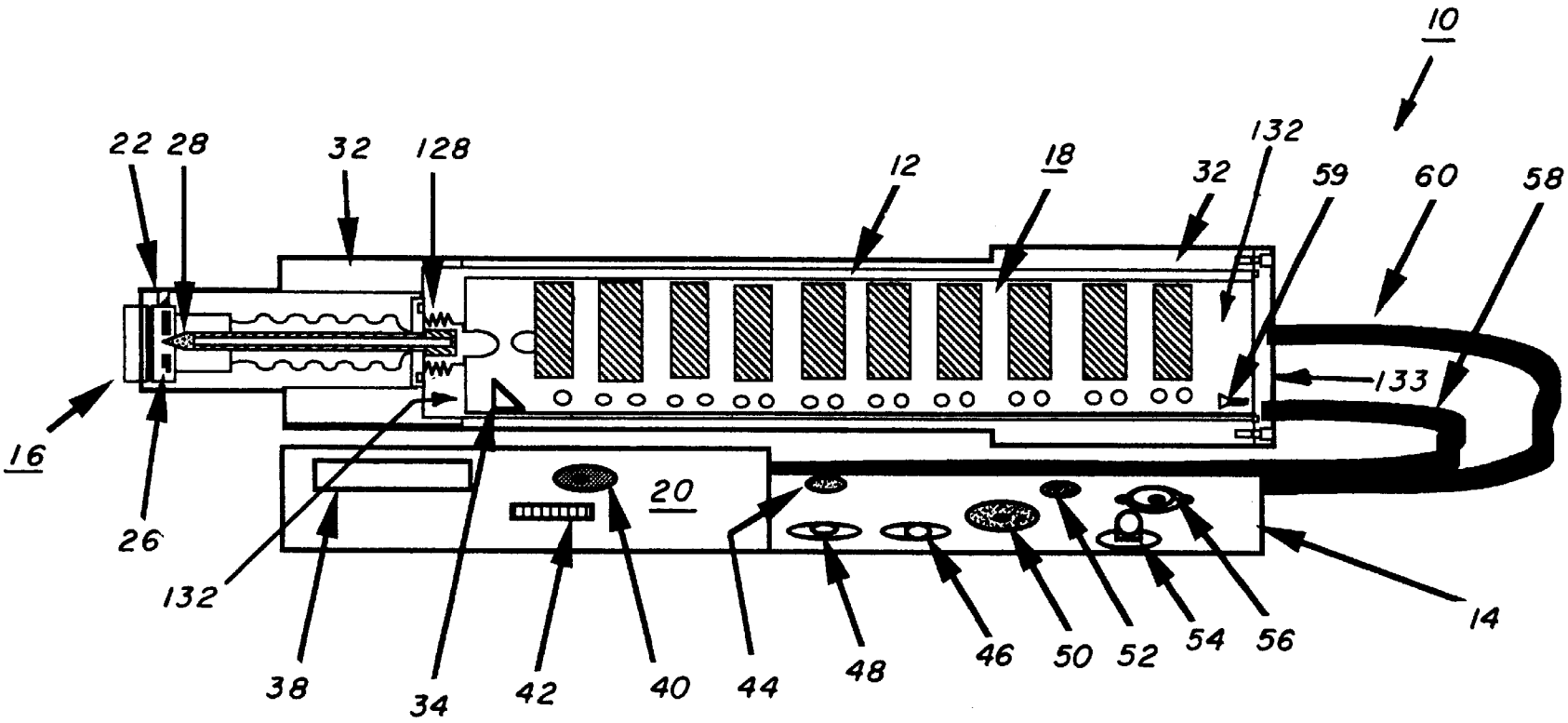
FIG. 1 illustrates a mobile X-ray unit in accordance with the present invention.
Figure 2:
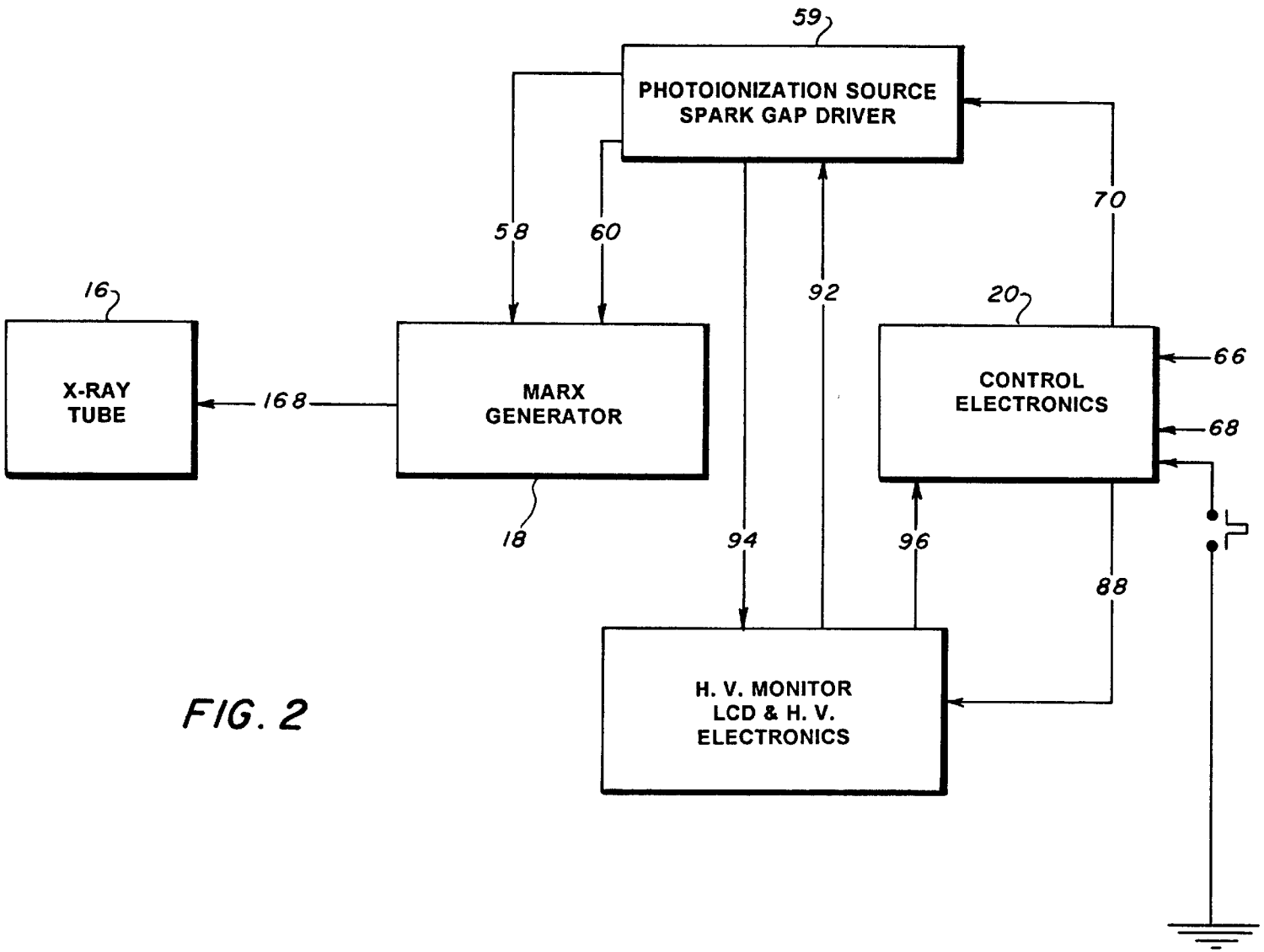
FIG. 2. is a block diagram of the essential functions related to the present invention.

One embodiment of the present invention is illustrated in FIG. 1 for the mobile X-ray unit 10. The mobile X-ray unit 10 comprises two aluminum enclosures 32 and 14, with the enclosure 32 housing an X-ray tube assembly 16 and a Marx generator 18, and with enclosure 14 housing control electronics 20 (not shown, but to be described with reference to FIGS. 2, 3 and 4, 5).

The pressurized housing 12, encloses the Marx generator spine 132, and forms a pressure seal at o-ring 138 at end plate 133, described with reference to FIGS. 6

Figure 6:
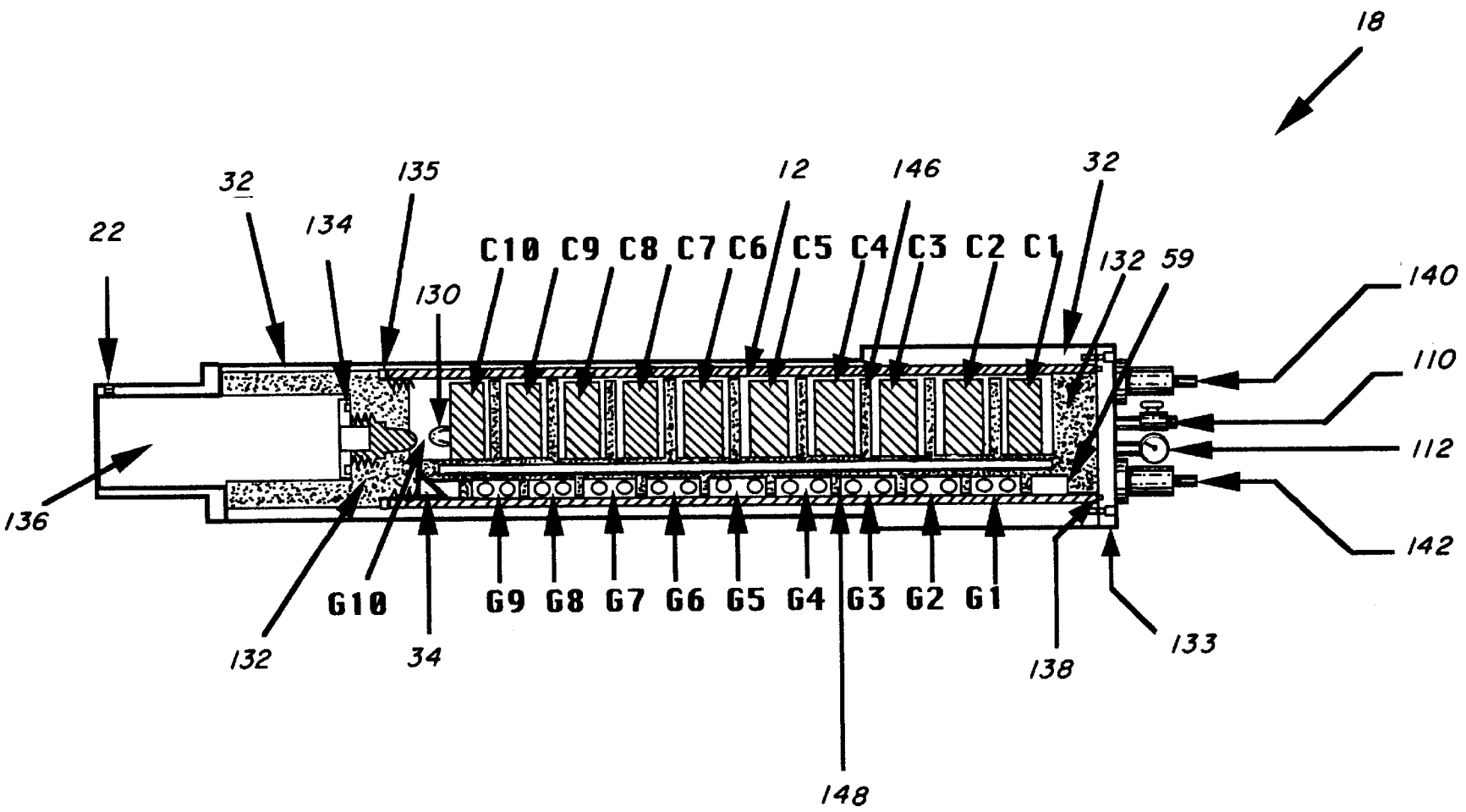
FIG. 6 is a schematic illustrating some of the mechanical features of the Marx generator of the present invention.
Figure 7:
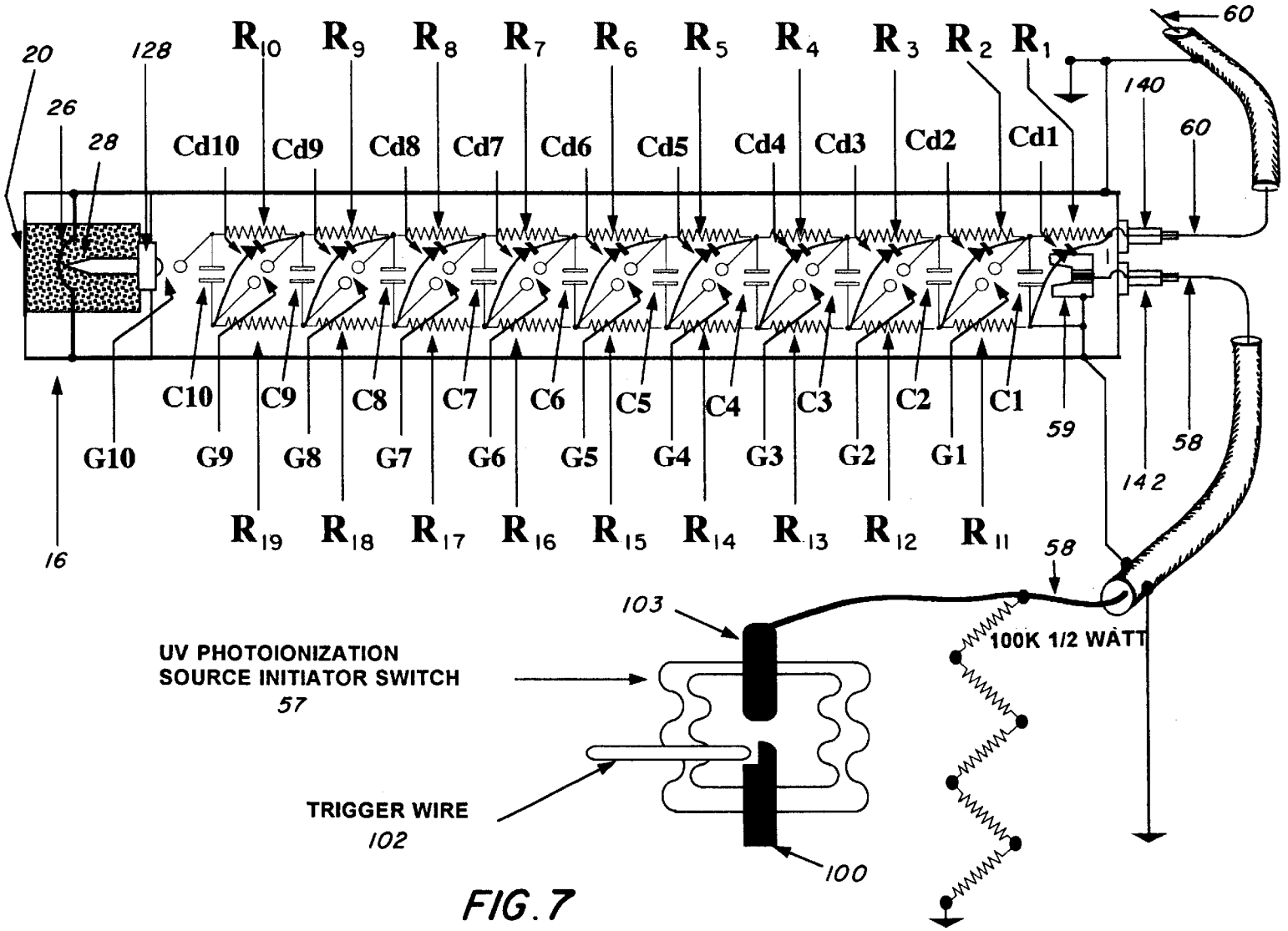
FIG. 7 is an equivalent circuit of the Marx generator of the present invention.

The Marx generator 18 of FIGS. 6 and 7 comprises a plurality of capacitors C1, C2, . . . and C10 that operate together with a plurality of spark-gap switches G1, G2, . . . and G10 and Clamping diodes Cd1, Cd2 . . . Cd10 referred to later. The charge state of the marx capacitors C1, C2 . . . C10 is indicated by light emitting diode bar graph array 42 (FIG. 1) as M1, M2, . . . and M10 (shown in FIG. 4 as device "$Q_{18}$") mounted on enclosure 14.

The enclosure 14 also contains provisions for accommodating a digital volt meter (DVM) 38, a potentiometer 40 that adjusts the voltage generated by the Marx generator 18, and a dot/bar graph display 42 that shows the charged state of the Marx generator 18. The enclosure 14 also provides a housing for receiving a fiber optic trigger input 44, a connector 46 for the receipt of a transistor transistor logic (TTL) trigger input, and a connector 48 making available a TTL trigger sync output. Further, the face of the enclosure 14 allows for mounting of a rotary switch 50, a manual trigger push button 52, a power on-off switch 54, and a battery charge input 56. The enclosure 14, in particular, the control electronic 20 within the enclosure 14 provides signals and functions for the Marx generator 18, via a cable 58 carrying, a high voltage (HV) trigger signal and a high voltage cable 60.

The Marx generator consists of a plurality of high voltage ceramic disc capacitors and spark gap switches. The capacitors contained in the Marx column 18 are charged to a H.V. in parallel via bleeder resisters RA in the resister chain. Each spark gap switch G1–G10, consists of two closely spaced spherical electrodes. The spark gap switches are arranged so that each charged capacitor C1–C10 in the Marx column is isolated from all other capacitors via resistors RA. The spark gap switches are mounted along a common optical axis together with an ultraviolet photoionization source 59, from the control electronics 20, and mounted in close proximity to the first spark gap switch G1, within the marx column 18.

Triggering of the Marx column begins with the control electronics 20 which initiates a high voltage trigger pulse from a H.V. trigger transformer 82 via path 102 into spark-gap device 57. Breakdown of this spark gap switch causes its impedance to collapse from an open circuit to a low impedance spark channel having a few tens of milliohms of resistance. This device 57, now transfers the energy stored in capacitor C0 to device 59 by way of path 58. The U.V. photoionization source 59 emits a large flash of hard U.V. created by the discharge of capacitor C0 into device 59 which is connected to the ground plane of the device 10.

The hard U.V. emitted from device 59 photoionizes spark gap G1, the closure of this switch places the first capacitor in the Marx column C1 in series with the second capacitors in the column C2 doubling the voltage across the second spark gap switch G2. The increased voltage stress across the second spark gap together with the hard ultraviolet illumination it receives from the closure of the first spark gap switch G1 causes it to break down quickly. This process continues at an accelerating rate until all capacitors in the Marx column are fully erected in series and have formed the center conductor of the coaxial device.

The full Marx voltage now appears across switch G10 which is connected to power feedthrough device 128 which transmits the H.V. output of the Marxed capacitors to the anode 28 of the X-ray tube 16, via conducting tube 168. The X-ray tube assembly 16 is held within the enclosure 32 by the clamping arrangement 22. The X-ray tube assembly 16 has a vacuum window 24, through which X-rays are emitted, and a cathode 26 and an anode 28 having one of its ends connected to a screw connection 30 that is mechanically engaged by a complementary arrangement, to be described with reference to FIG. 8. The X-ray tube assembly 16 is mechanically connected to the system 10 by way of a mating contact plugged into feedthrough power connector 128. The outer conducting member 162, of the X-ray tube 16, is clamped into the outer shell 32 by means of screws 22 placed 120 degree's apart. Application of the full Marx potential across the anode-cathode gap of the X-ray tube 16 produces an intense electric field between the wires in the mesh of the cathode and the surface of conical shaped anode. This electric field extracts electrons from the cathode by the process of cold field emission. The electrons accelerate towards the anode where they collide and produce Bremmstrahlung and K-line radiation. This radiation continues until the plasma produced at the cathode crosses the gap and shorts out the tube. Plasma closure in our tube sets the X-ray pulse width at 50 nanoseconds.

The operation of the control electronics 20 may be further described with reference to FIG. 3 illustrating a plurality of circuit elements indicated by conventional symbols, such as a resistance symbol, and identified by typical component values and also illustrating various logic elements most identified with the term Q serving as their indicated logic function and some of which logic elements are of the type given in Table 1.

TABLE 1

| NOMENCLATURE | FUNCTION/TYPE |
|---|---|
| Q1 | HEWLETT PACKARD (HP-R-2503) OPTICAL RECEIVER |
| Q2 | PULSE STRETCHER (LM555) |
| Q5 | 5 VOLT REGULATOR (7805) |
| Q6 | ENCO 300 VOLT SUPPLY) |
| Q9 | DUAL TIMER (LM556) |

The control electronics 20 have the capability of accepting either of three input signals, each of which serves as a trigger to start the operation of an X-ray mobile unit 10 for the generation of the associated X-rays. The three input signals are: (a)the optical pulse of 650 nanometers, present on signal path 68 and received by the Q1 device. (b) the input from connector 46 the pulse generated by the TTL logic present on signal path 66 and accepted by the Q3 device. (c) and a manual pulse generated by the manually activated push-button 52. The selection of either of these three input signals is accomplished by the selection of the rotary switch 50 arranged as shown in FIG. 3.

Either of these input signals activates the Q2 device so that the control electronics 20 will not respond to another input signal for a predetermined time, such as 330 milliseconds, which reduces the unwanted possibility of repetitive triggering caused by closely spaced input pulses. The Q2 device produces an output pulse which is then shaped by edged differentiation provided by the circuit components on the input stage of the Q4C nand gate which inverts its received signal and transfers it to the base of a common emitter formed by element Q5 and its associated circuit components. The inverted output of nand gate Q4C is also routed to a further nand gate Q4D which, in turn, provides a sync output to connector 48 which, in turn, provides the sync pulse on to signal path 78, to be described with reference to FIG. 9.

The collector of the Q5 device is connected to the primary of a toroidal trigger transformer 80. The pulse signal present at the primary of transformer 80 appears across the secondary of transformer 80 and triggers an SCR device, indicated as D6, which discharges the 1.0 microfarad capacitor connected to the anode of D6. The energy discharge of the 1 $\mu$f capacitor is applied to signal path 70 that is routed to a H.V. trigger transformer 82 that assists in rendering the first spark-gap device 57 conductive in a manner as to be described with reference to FIG. 5.

In addition, the control electronics 20 contain a battery charged state indicator circuit Q8–Q11, that indicates when the X-ray mobile unit 10 battery 81, preferably a 12 volt device, needs to be charged. This indication is accomplished by flashing the back light of the digital voltage meter 38, see FIG. 1 The flashing of the DVM black-light is accomplished by the operation of the Q9 device which uses its first timer as a comparator and provides an output that is used to carry the second timer's reset line high. The second timer of the Q9 device is now free to oscillate and strobes, via signal path 84, a transistor switch comprised of transistors Q10 and Q11 which sinks, via signal path 86, the current through the LED back-light of the digital voltage meter DVM 38. The 12V output is applied to signal path 88 which is routed to the control electronics illustrated in FIG. 4. The onslaught of the flashing begins when the voltage of the 12 volt battery reaches about 9 volts. The remainder of the control electronics 20 may be further described with reference to FIG. 4 which illustrates a plurality of circuit elements indicated by conventional symbols, such as those of a resistor, identified by typical component values and also illustrates various logic elements most identified with the term Q, and some of which are given in Table 2.

TABLE 2

| NOMENCLATURE | FUNCTION/TYPE |
|---|---|
| Q12 | 0–13 kV SUPPLY OF ENCO MODEL 4300 |
| Q13 | 0–12 VOLT SUPPLY OF ENCO MODEL 9414 |
| Q14 | VOLTAGE REGULATOR (7805) |
| Q15 | OPERATIONAL AMPLIFIER (OP295) |
| Q17 | BAR/DOT DISPLAY DRIVER (LM3916) |
| 38 | DIGITAL VOLTAGE METER OF MODUTEC (0–200 mV FULL SCALE) |

The control electronics 20 of FIG. 4 includes a DC to DC converter comprised of elements Q12, Q13, Q14 and associated circuit components arranged as shown in FIG. 4. Element Q13, via signal path 88, accepts a voltage signal of approximately 9–14 volts DC and produces, on signal path 90, a constant 24 volts DC output for current loads of preferably no more than 1 ampere. The element Q12 which is a programmable high voltage supply provides a voltage of between 0–13 kV that is applied to the Marx generator 18, via signal path 92. The output of the element Q12 is regulated to 0.1%.It no load to full load and can provide 0.33 milliamps of current at 13kv.

Figure 5:
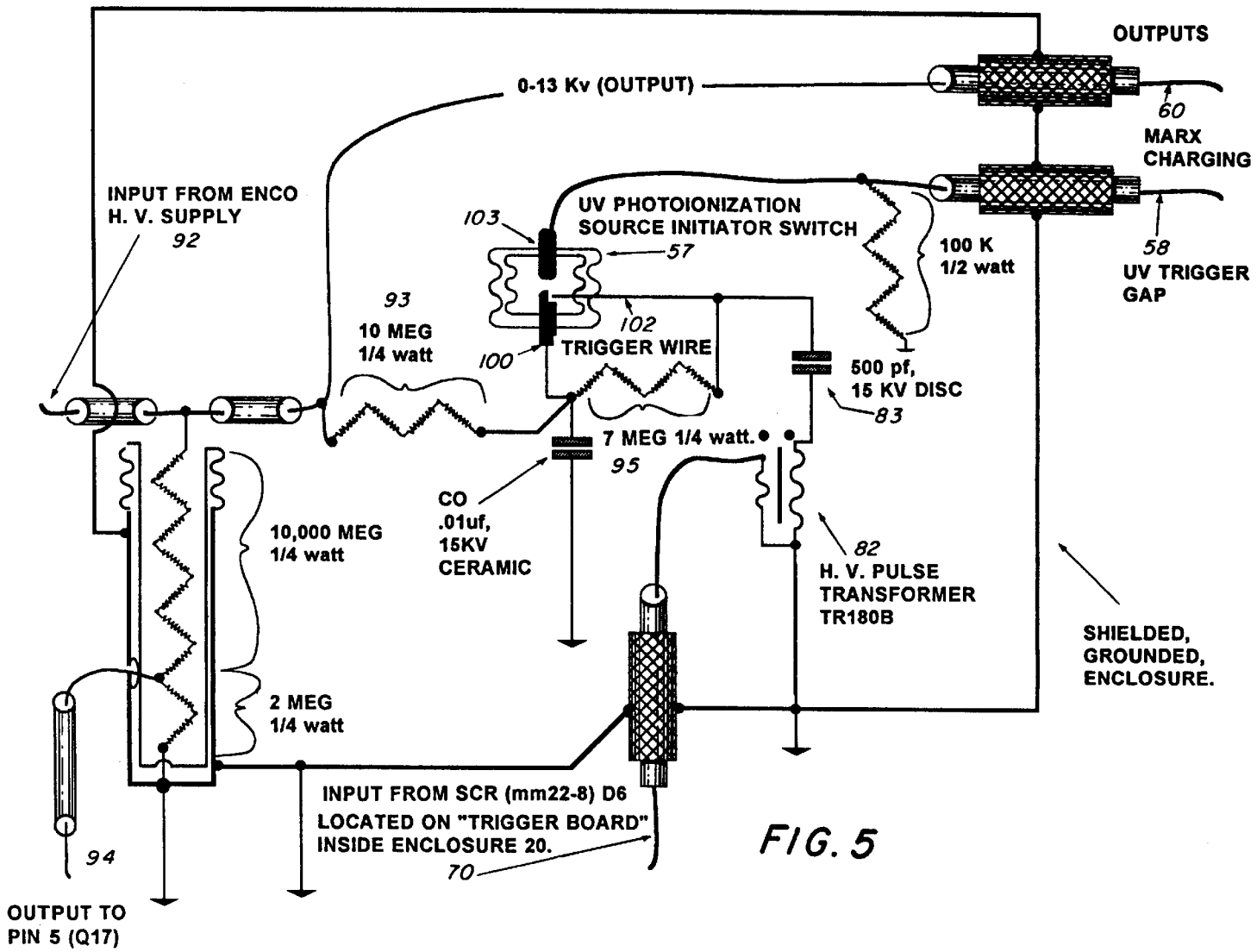
FIG. 5 is a blow-up of the pulsed power circuit of device 57

The signal path 60 is routed to the Marx generator 18 by way of a charge line 92 that comprises a ten megohm resistor 93, a seven megohm resistor 95, and a 0.1 microfarad capacitor which is actually capacitor C0 arranged as shown in FIG. 5. The charge line 92 provides an output on signal path 94 that is routed to the Q17 element which is a bar/dot display driver.

The program voltage input to element Q12 is also monitored, via signal path 96, by element Q15 A and its associated circuit components acting as a first operational amplifier configured as a voltage follower and which impresses its output voltage across a low voltage divider which is passed onto element Q15B serving as a second operational amplifier. Q15B provides an output signal serving as the programming voltage monitor of the H.V. capacitor charging supply, this voltage is routed to the element Q17. The HV output of Q12 is monitored by a 5000x attenuator and is sent to element Q17 via signal path 94.

The difference between the signal developed by elements Q15B and the voltage attenuator is applied to element Q17,this is used to drive Q18 which contains 10 LED's (M1, M2, . . . M10 shown in FIG. 4) that indicate the charge state of the Marx generator 18.

The output voltage (0–13 kV) generated by element Q12 is adjustable by potentiometers, such as potentiometer 40, that are electrically connected, as shown in FIG. 4, to signal paths 96 and 100.

The charge line 92 that carries the 0–13 kV potential has its 10 megohm resistor 93 and its 0.01 capacitor C0 connected between the lower spark-gap terminal 100 or anode electrode of the spark-gap switch 57. A trigger pin wire 102 extends through the outer body of the spark-gap switch 57 and runs, but does not touch, the cathode electrode 100. The trigger pin wire 102 is biased to the fully charged potential of the 0.1 microfarad capacitor (C0) by way of a 7 megohm resistor. The trigger pin wire 102 is connected to a 500 picofarod decoupling capacitor which, in turn, is connected to the trigger transformer 82, whose primary winding is connected to signal on signal path 70 previously discussed with reference to FIG. 3.

When the signal present on signal path 70 is applied to the primary side of the trigger transformer 82, it produces a 25 kilovolt pulse at the secondary of transformer 82. When the 25 kilovolt pulse passes through the 500 picofarad decoupling capacitor, it appears as a spark in the air gap between the trigger pin wire 102, the anode electrode 100. The cathode electrode 103 connected to the ground potential via a 100 k resistor to be described with reference to FIG. 7. The spark photoionizes the region just in front of the cathode 103 which results in the formation of a breakdown channel between the cathode and the anode 100 of the spark-gap switch 57. The plasma produced by the breakdown channel rapidly fills the anode-cathode gap of the spark gap device 57, thereby, producing a low resistance path for the 0.1 microfarad capacitor C0. The output from capacitor C0 (shown in FIG. 5) is sent through device 57 (shown in FIGS. 5 and 7) to cable 58 (shown in FIGS. 1, 5 and 7). Cable 58 is connected through the high voltage connector 142 (shown in FIGS. 6 and 7) to photoionization source 59 (shown in FIGS. 6 and 7).

The Marx generator 18 has mechanical features which are important to the present invention and may be further described with reference to FIG. 6.

FIG. 6 illustrates the enclosure 32 as being cut-away so as to expose the internally housed components primarily related to the Marx generator 18. Enclosure 32 has two inlets 110 inlet valve and 112 pressure measuring inlet (FIG. 6) which enter the pressurized cylinder, to be described hereinafter, that is confined within the chamber 32. Chamber 32 is defined by its conducting aluminum walls, wherein the internal walls thereof fit over an acrylic insulating cylinder or chamber 12 both of which cooperate in a manner to be described with reference to FIG. 6 to form a return path for the lumped element transmission line formed by the capacitance between the marxed capacitors and the wall of enclosure 32, the connection and switching inductance between each capacitor and it's neighbor. The Marx generator 18 comprises capacitors C1, C2, . . . and C10, and spark-gap devices G1, G2, . . . and G10 to be further described hereinafter with reference to FIGS. 6 and 7 and all of which are held by a polycarbonate spine 132.

The capacitors C1, C2, . . . C10 and the spark-gap devices G1, G2, . . . and G10 are affixed to the polycarbonate rod machined into a spine configuration 132 by appropriate means, known in the art. The polycarbonate spine 132 does not occupy the complete space between the acrylic cylinder 12 but now leaves, at one of its ends, the chamber 12 into which is introduced a pressurized gas, via valve 110 which may be monitored with a pressure meter 112. The other end of the polycarbonate spine 132 abuts up to within 1 mm of the power feedthrough 128. The spine 132 carries and allows for the attachment of a turning mirror 34 shown in FIG. 1, and to be further described with reference to FIG. 6.

The power feedthrough 128 also provides a path for the electrical connection between G10 and the X-ray tube 16. More particularly, when the screw electrode 128 is screwed into the insulating spine 132 it causes the Marx generator 18 to be electrically connected to the anode 28.The insulating spine 132 shown in FIG. 6, as well as the acrylic cylinder 116, abuts up against the O-ring pressurized seal 134. The O-ring pressurized seal 134, in cooperation with the aluminum housing 32, provides an entrance passageway 136 into which the X-ray tube 16 of FIG. 1 is inserted. The aluminum enclosure 32 as well as the acrylic cylinder 116 mate with a second O-ring pressurized seal 138.

The O-ring pressurized seal 138 and the enclosure 32 have provisions that provide for the mating with a high voltage connector 140. The output terminal of connector 140 has a diameter of about 1.27 centimeters and allows for the soldering thereto of a resistor charging ladder network to be described hereinafter with reference to FIG. 7.

In operation, the chamber 12 is pumped to a vacuum pressure of approximately $10^{-3}$ torr and back filled with dry nitrogen gas to a pressure of preferably about 25 to 30 psi. The 2 atmosphere pressure of nitrogen gas allows for the spark-gap electrodes G1, G2 . . . and G10, previously discussed with reference to FIGS. 1 and 7, to be separated by about 1 mm. As shown in FIG. 6, the capacitors C1, C2, . . . and C10 are respectively physically separated from each other by barriers 146, whereas the spark-gap devices G1, G2, . . . and G10 are separated from each other by barriers 148. The barriers 146 and 148 are part of the polycarbonate spine 132. Capacitor C1, C2 . . . and C10 have a very high dielectric constant of about 7000, and may be further described with reference to FIG. 7.

FIG. 7 illustrates the Marx generator 18 which is a conventional impulse-type high-voltage circuit in which capacitors C1, C2, . . . and C10 are charged in parallel through a high-resistive ladder network formed by resistors R1–R19 having a typical value of 100 k and arranged as shown. When the capacitor voltage reaches a critical value, such as 13 kv, the capacitors are discharged in series through the spark-gap devices G1, G2 . . . and G10 in response to a trigger signal, produce a high-voltage pulse which is applied to the anode 28 of the X-ray tube 16.

FIG. 7 shows an equivalent circuit of the Marx generator 18 that employs clamping diodes Cd1, Cd2, Cd3, Cd4, Cd5, Cd6, Cd7, Cd8, Cd9 and Cd10 arranged as shown, that act to dampen any negative ringover associated with the capacitors when the capacitors are discharged into the inductance of the X-ray tube 16. The Marx generator 18, in particular the first stage thereof having the spark-gap device 57 previously discussed with reference to FIG. 5, preferably utilizes an ultraviolet initiator device 59 which may be described with reference to FIG. 7.

FIG. 1 illustrates the turning mirror 34, which directs the hard, ultraviolet light pulse. FIG. 6 further illustrates how the turning mirror is positioned within the insulating spine 132. The turning mirror tilted 45° from the line of sight of spark gap switches G1–G9 so that it directs the ultraviolet light pulse to the region between the electrodes 130 and 128 of spark-gap device G10 located at the output stage of the Marx generator 18. As previously discussed with reference to FIG. 3, the discharge of the 1 microfarad capacitor onto signal path 70 is applied to the trigger transformer 82 which develops at its secondary a 25 kV pulse. When the 25 kV pulse passes through the 500-picofarad decoupling capacitor, it appears as a spark in the gap between the trigger pin wire 102 and anode and cathode and anode electrodes 100 and 103. As previously discussed with reference to FIG. 4 and 5, the spark transitions the normally high resistance path between the cathode and anode electrodes of device 57 to a low resistance path. One end of the low resistance path is indicated with the reference number 58 previously discussed with reference to FIGS. 5 and 7.

The low resistance spark channel formed in device 57 causes the rapid discharge of capacitor C0 through path 58. Cable 58 enters the Marx unit 18 by way of connector 142 and is connected to the U.V. initiator 59 which emits a large flash of hard U.V. and causes the sequential cascaded discharge of the capacitors C1–C10 which have been charged parallel through Resistor chain R1–R19 described in FIG. 7, are then discharged through spark gap switches G1–G10. This path formed by the spark gap switches G1–G10 forms the center conductor of the coaxial device 18 in FIG. 6.

The capacitors C1–C10 have a typical value of 0.01 $\mu$f and are arranged on the polycarbonate spine 132 as illustrated in FIG. 6, further, the separation between the capacitors provided by the polycarbonate spine 132 decrease the interstage capacitance. The low interstage capacitance, in cooperation with the relatively low inductance of the spark gap switches G1–G10 , allows the capacitors C1–C10 to completely discharge into the X-ray tube 16 within nanoseconds. This fast discharge eliminates the need for any coaxial cables which would normally be used to sharpen the high-voltage pulse emerging from the Marx generator. The elimination of these coaxial cables reduces the overall weight of the mobile X-ray unit 10, while increasing its mobility.

Figure 8:
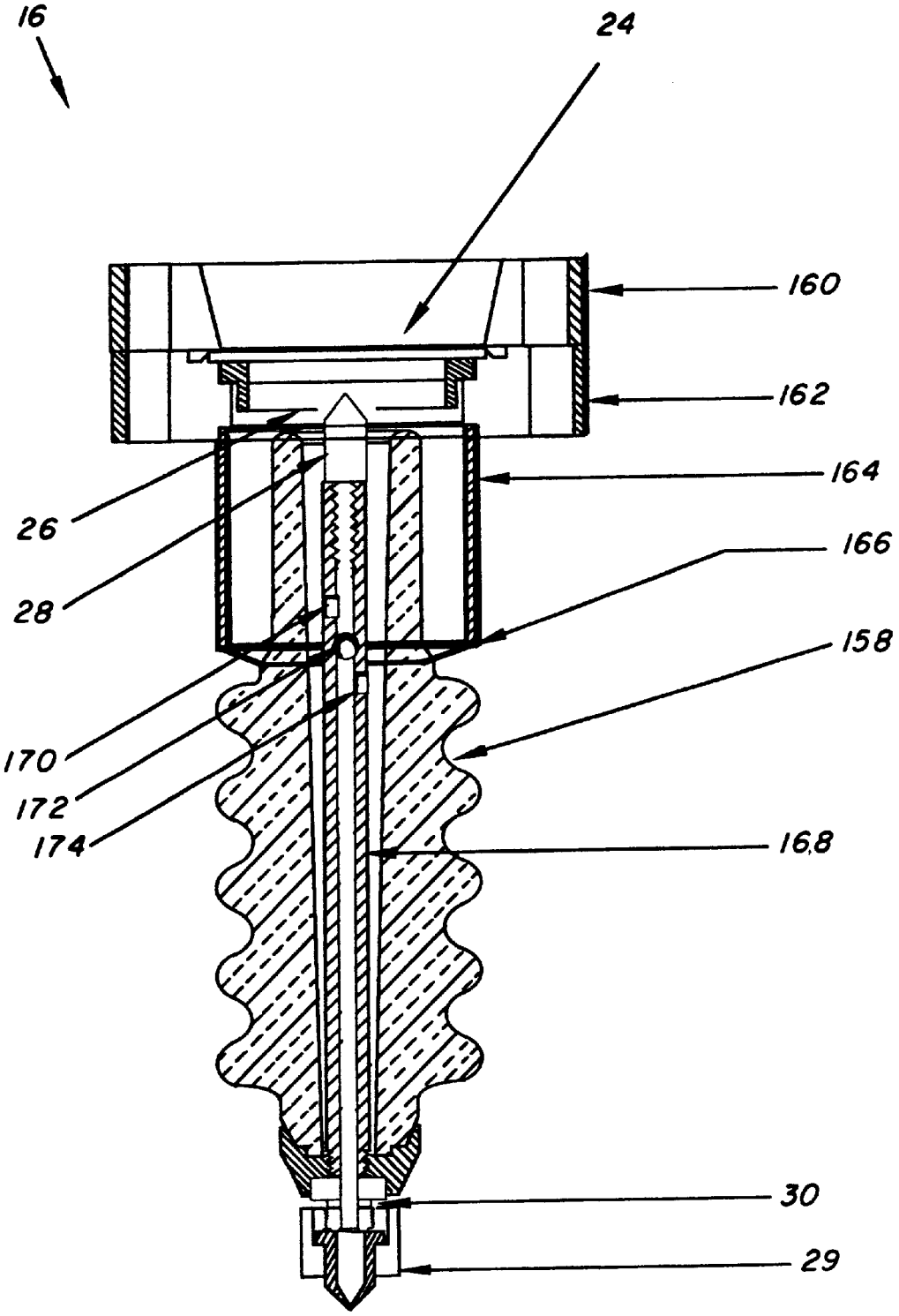
FIG. 8 illustrates the X-ray tube assembly of the present invention.
Figure 9:
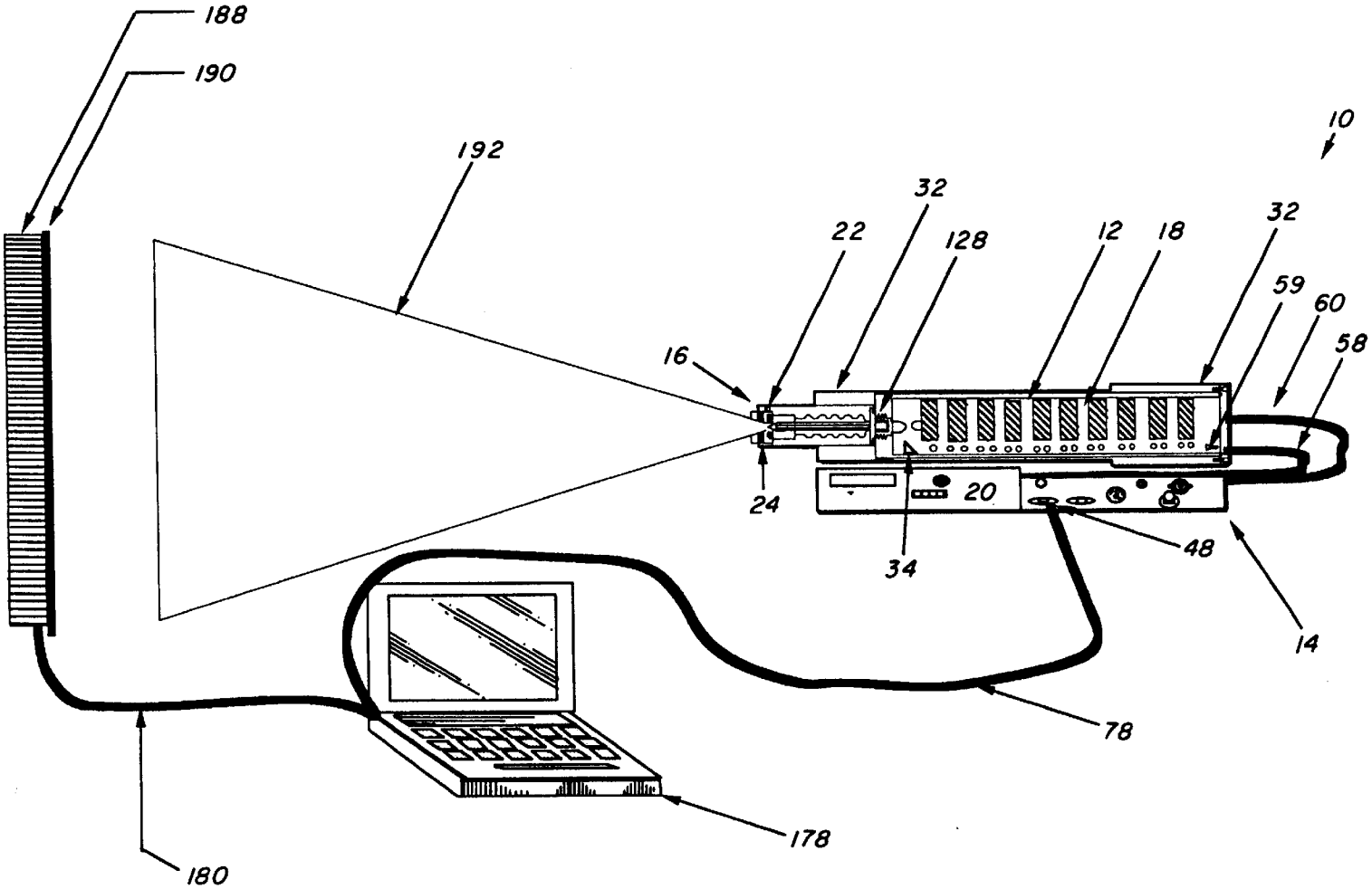
FIG. 9 Details the X-ray unit in one typical application thereof.

The mobile unit 10 having the parameters hereinbefore described provides for the generation of a high voltage pulse having a duration of less than 100 nanoseconds. This high voltage, high energy pulse is adjustable by means of the potentiometers shown in FIG. 4, in particular, the potentiometers electrically connected to signal paths 96 and 100. The high voltage pulse developed by the Marx generator 18 is applied to the anode 28 of the X-ray tube 16 by means of the spark gap electrode 130 shown in FIG.6 The x-ray tube 16, shown in FIGS. 1, 8 and 9, is a field emission type comprised of a geometric arrangement of anode 28 and cathode 26 derived from the well known "Siemens-tube" configuration. More particularly, the X-ray tube 16 has a conical copper/tungsten anode 28, and a stainless steel mesh punched to form an anode cathode 26. The X-rays are extracting from the X-ray tube along a tube axis and as a result of a conical anode 28, the emitting area is about 2 mm in diameter. The X-ray tube 16 uses a commercially available 30 kV DC ceramic insulator 158 bonded to conflat flanges 160 and 162 each having a typical diameter of 2.75 inches. The conflat flanges 160 and 162 are mated to a stainless steel tube 164 having a typical outer diameter of 1.5 inches and an inner diameter of 1.375 inches. The stainless steel tube is connected to an adapter plate 166.

The anode stalk 168 is a tube having a typical outer diameter of 0.24 inches and a typical inner diameter of 0.125 inches. The x-ray tube is evacuated through the center of the anode tube by way of holes 170,172 and 174 arranged in a spiral so as not to weaken the anode tube 168. As seen in FIG. 1, the enclosure 20 encloses and confines the main power producing components that generate the high voltage potentials of 0–13 kV. The charge lines 58 and 60 comprise coaxial cable that carries a relatively high voltage of 0–13 kV and whose outer conductor, enclosure 32 provides a return path for the charge line 92, shown in FIG. 4.

It should now be appreciated that the practice of the present invention provides for an X-ray mobile unit 10 having compact electronics so as to provide complete shielding against electromagnetic interference. Further, it should be appreciated that the present invention utilizes electronic components that are relatively small so that the overall weight of the mobile X-ray unit 10 is approximately 26 pounds. Further, it should be appreciated that the mobile X-ray unit 10 has the ability, via the potentiometers shown and described with reference to FIG. 4, to develop an excitation that is applied to the Marx generator 18 which develops a high voltage output signal having an amplitude which is adjustable to adapt to various applications, one of which may be further described with reference to FIG. 9.

FIG. 9 illustrates an arrangement that includes a notebook computer 178, known in the art, which is connected to the sync output 48 of enclosure 14 having thereon a trigger output signal placed on signal path 78, previously described with reference to FIG. 3. The notebook computer 178 has an output cable that is connected to a CCD x-ray camera 188.

Portability of the notebook computer 178, the CCD x-ray camera 188, and the mobile X-ray unit 10 allows for the practice of the present invention to be utilized in: Dentist's offices, medical, Veterinary offices and security applications. The unit can provide a high quality image; produced by the mobile X-ray unit 10 of the present invention.

It should now be appreciated that the practice of the present invention provides for a mobile X-ray unit 10 utilized for various applications.

It should further be thoroughly understood that many modifications and variations of the present invention are possible within the purview of the claimed invention. It is therefore to be understood that, within the scope of the appended claims, the invention may be practiced otherwise than as specifically described.

What we claim is:

1. A mobile X-ray unit comprising:

an X-ray tube having an anode and a cathode and an anode-cathode gap therebetween;

a power supply for providing a predetermined voltage;

control electronics having first input and first output stages, said first input stage being responsive to at least one input pulse for generating a first trigger pulse at said first output stage; and a Marx generator having second input and second output stages, said second output stage being coupled across said anode and said cathode of said x-ray tube, said Marx generator comprising:

a plurality of spark gap switches, including first and last spark gap switches, and a UV photoionization source, each of said spark-gap switches and said UV source having anode and cathode electrodes spaced apart from each other by a predetermined distance and providing a high resistance path therebetween, said UV photoionization source generating a second trigger pulse which acts to sequentially close said plurality of spark-gap switches, said second input stage being coupled between said anode and said cathode electrodes of said first spark-gap switch;

a plurality of capacitors coupled to said power supply and arranged in parallel so that each capacitor is charged to said predetermined voltage from said power supply, said plurality of capacitors being arranged in cascade with said spark-gap switches so as to be discharged in series in response to said second trigger pulse and produce an output pulse at the output stage of the Marx generator having an amplitude that is proportional to the accumulative voltage to which said plurality of capacitors are charged.

2. The mobile X-ray unit of claim 1 wherein:

each of said plurality of capacitors is a ceramic disc formed of a barium titanate disc having a value of about 0.01 microfarads.

3. The mobile X-ray unit of claim 2 wherein:

said plurality of capacitors is responsive to said trigger pulse for serially discharging to produce a sum voltage equal to the accumulative voltage to which said plurality of capacitors are charged and applies this sum voltage to said anode of said X-ray tube.

4. The mobile X-ray unit of claim 3 wherein:

said X-ray tube is responsive to the sum voltage produced by the Marx generator for producing an X-ray pulse having a duration of about 50 nanoseconds.

5. The mobile X-ray unit of claim 1 wherein:

said plurality of capacitors are held on a polycarbonate rod having a spine configuration.

6. The mobile X-ray unit of claim 1 further including:

a plurality of clamping diodes respectively coupled in parallel with said plurality of capacitors for minimizing negative ringover in said plurality of capacitors upon discharge.

7. The mobile X-ray unit of claim 1 further including:

a conducting cylinder fitted over said Marx generator for providing a return path confining any unwanted electronic radiation.

8. The mobile X-ray unit of claim 7 wherein:

said insulating cylinder comprises an aluminum member fitted over an acrylic material.

9. The mobile X-ray unit of claim 1 further including a pressurized insulating cylinder, said insulating cylinder containing:

said Marx generator for preventing high voltage breakdown between said Marx generator and ground; and a conducting cylinder closely fitted over the insulating cylinder for for providing a conducting return path for discharge of said capacitors within said Marx generator.

10. The mobile X-ray unit of claim 9 wherein:

said conducting cylinder is comprised of a light weight conductive metal.

11. The mobile X-ray unit of claim 10 wherein:

said conductive metal can be selected from the group consisting of aluminum, magnesium, titanium and combinations thereof.

12. The mobile X-ray unit of claim 9 wherein said insulating cylinder is selected from the group consisting of polycarbonate, acrylic, glass reinforced epoxy resins, and combinations thereof.

13. The mobile X-ray unit of claim 6 wherein:

said mobile X-ray unit is battery powered, completely portable, and occupies a volume less than one-half of a cubic foot.

14. The mobile X-ray unit of claim 3 wherein:

said plurality of capacitors, said plurality of spark gap switches, said plurality of clamping diodes, and the UV photoionization source are contained within said insulating cylinder.

15. The mobile X-ray unit of claim 8 wherein:

said plurality of spark gap switches are disposed in sequence along an optical path which facilitates the photoionozation of said plurality of spark gap switches.

16. The mobile X-ray unit of claim 1 wherein:

said UV photoionization source includes an anode wire surrounded by a ceramic insulator disposed within said cathode, said anode wire being responsive to said second voltage pulse from the control electronics for establishing a high current discharge across the surface of said ceramic insulator and producing thereby an intense hard ultraviolet pulse.

* * * * *